US007942643B2

(12) United States Patent
Cho et al.

(10) Patent No.: US 7,942,643 B2
(45) Date of Patent: May 17, 2011

(54) DEVICE AND METHOD FOR PUMPING FLUIDS EMPLOYING THE MOVEMENT OF GAS BUBBLES IN MICROSCALE

(75) Inventors: Hye-jung Cho, Gyeonggi-do (KR); Natalia Ivanova, Tyumen (RU)

(73) Assignee: Samsung Electronics Co., Ltd., Suwon-si (KR)

( * ) Notice: Subject to any disclaimer, the term of this patent is extended or adjusted under 35 U.S.C. 154(b) by 910 days.

(21) Appl. No.: 11/006,650

(22) Filed: Dec. 8, 2004

(65) Prior Publication Data

US 2005/0129529 A1 Jun. 16, 2005

(30) Foreign Application Priority Data

Dec. 15, 2003 (KR) ..... 10-2003-0091467

(51) Int. Cl.
*F04B 19/24* (2006.01)
*F04B 1/18* (2006.01)

(52) U.S. Cl. ..... 417/207; 417/208; 417/51

(58) Field of Classification Search ..... 417/207, 417/208, 209, 48, 51
See application file for complete search history.

(56) References Cited

U.S. PATENT DOCUMENTS 4,795,243 A * 1/1989 Suzuki ..... 359/296
5,599,502 A 2/1997 Miyazaki et al.
6,283,718 B1 * 9/2001 Prosperetti et al. ..... 417/52
6,655,924 B2 * 12/2003 Ma ..... 417/209
2002/0142471 A1 10/2002 Handique et al.
2003/0086790 A1 5/2003 Ma
2004/0076531 A1 * 4/2004 Takeuchi et al. ..... 417/322

OTHER PUBLICATIONS

Ozaki K Ed: Institute of Electrical and Electronics Engineers: "Pumping Mechanism using Periodic Phase Changes of a Fluid", Proceedings of the Workshop on Micro Electrical Mechanical Systems (MEMS), Amsterdam, Jan. 29-Feb. 2, 1995, New York, IEEE, US, vol. Workshop 8, pp. 31-36.
Bezuglyi et al. "Gas Bubbles in a Hele-Shaw Cell Manipulared by a Light Beam." Technical Physics Letters, vol. 28, No. 10, 2002, pp. 828-829.
Communication issued Apr. 9, 2010 by the Korean Intellectual Property Office for Korean Patent Application No. 1020030091467.

* cited by examiner

*Primary Examiner* — Devon C Kramer
*Assistant Examiner* — Peter J Bertheaud
(74) *Attorney, Agent, or Firm* — Sughrue Mion, PLLC

(57) ABSTRACT

The present fluid pumping method for micro-fluidic devices uses gas bubbles to move fluid by light beams. The light beams are emitted to the fluid near the gas bubble through an optically transparent cover and correspondingly heat the fluid in the micro channels. The liquid temperature variation changes the surface tension of the gas bubble near the heated fluid side, therefore, a pressure gradient between the end portions of the gas bubble generates accordingly. By moving the light beams, the moved pressure difference will be achieved, which will drive the gas bubbles and pump the fluid. Such a fluid pumping can simplify the structure of a micro-fluidic device and eliminate heat loss because of using a controllable light beam.

13 Claims, 5 Drawing Sheets

DEVICE AND METHOD FOR PUMPING FLUIDS EMPLOYING THE MOVEMENT OF GAS BUBBLES IN MICROSCALE

CROSS-REFERENCE TO RELATED APPLICATIONS

This application claims benefit under 35 U.S.C. §119 from Korean Patent Application No. 2003-91467, filed on Dec. 15, 2003, the entire content of which is incorporated herein by reference.

BACKGROUND OF THE INVENTION

1. Field of the Invention

The present invention relates to a device and method for pumping fluids, and more particularly, to a device and method for pumping fluids employing the movement of gas bubbles through channels in microscale.

2. Description of the Related Art

A micro-fluidic system refers to a system combining fluid dynamics and Micro-Electro-Mechanical Systems (MEMS), which can control fluid flows in micro units. For example, systems are being developed to perform tasks such as extracting DNA from very small test samples, checking gene mutation, and so on.

Pumping fluids such as bio-fluids and chemical solutions through microscale channels is closely related to future micro-fluidic systems such as lab-on-a-chip (LOC) or micro total analysis systems (μTAS).

U.S. Pat. No. 6,071,081 discloses a heat-powered liquid pump applying a film-boiling phenomenon. The pump is constructed with a chamber having inlet and outlet valves and a heating system located on the bottom surface of the chamber. The liquid is heated in the chamber by the heating system to form bubbles. The bubbles repeatedly expand and contract due to heat energy pulses. The bubbles act as a pressure source to expel liquid out of the chamber during bubble expansion and to draw liquid into the chamber during bubble contraction. Such a method can separate and transport liquid. The delivery volume of the pump depends on the bubble size and numbers.

The above method has a disadvantage of degrading reliability where the pump runs for an extended time since small actuating values employed for net fluid movements, and preventing reverse flows, are delicate parts that have to be very carefully manufactured. Delicate parts like those can be damaged during extended pump running times.

The paper of J. H. Tsai and L. Lin on "*A thermal-Bubble-Actuated Micronozzle-Diffuser Pump*" published on *J. Microelectromechanical Systems*, Vol. 11, No. 6, pp. 665-667 in 2003 addresses a mechanism for periodically re-forming and collapsing thermal bubbles. The micro pump has a resistance heater, a pair of nozzle-diffusing flow controllers, and a pumping chamber. Net flows are produced from the nozzles to the diffuser. This micro pump has some disadvantages such as particles possibly blocking the nozzle diffusion paths and damage to the pumping chamber due to bubble-collapsing pulses.

U.S. Pat. No. 6,283,718 discloses a method of pumping liquid through channels. The liquid is disposed within a liquid chamber or channel. Power is applied to a micro pump to form vapor bubbles in the chamber or channel. Through a formation and collapsing cycle of the vapor bubbles, a pumping action of the liquid is effectuated.

The paper of Song and Zhao on "*Modeling and test of thermally-driven phase change non-mechanical pump*" published on *J. Micormech. Microeng, Vol.* 11, pp. 713-719 in 2001 discloses a non-mechanical micro-pump driven by phase change. The pump has a glass tube and a few thermal elements distributed uniformly. Through control of the thermal elements along the glass tube, a pumping action is created. That is, changing the location where power is applied to heat sources produces the movement of vapor bubbles, which results in the pumping of liquid.

The above pump requires a high power consumption of more than 10 Watts, features slow thermal responses, and requires manual control of phase growth.

One severe disadvantage of the aforementioned pumping principles and pumps is that heating the pumped fluids to its boiling point can not be applied to most pumped fluids and corresponding micro-fluidic devices.

The paper of N. R. Tas, T. W. Berenschot, T. S. J. Lammerink, M. Elwenspoek, A. Van den Berg on "*Nanofluidic Bubble Pump Using Surface Tension Directed Gas Injection*" published on *Anal. Chem. Vol.* 74, pp. 2224-2227 in 2002 addresses a method of manipulating liquid with a hydrophilic fluid channel having a minutely machined surface. The method is based on surface tension-directed gas injection through minute-sized holes in the channel walls. The injected gas is discharged by asymmetrically cross-sectioned surfaces of the micro channels, by which an infinitesimal quantity of liquid is transported.

The drawback to this micro pump goes to specific structures of a manual pressure-applying mechanism and micro channels. Other disadvantages of such a pumping principle include a complicated manufacturing process and conductive heat loss. The inaccurate control on bubble transportation through channels and heaters requires a certain countermeasure on temperature control and packaging.

SUMMARY OF THE INVENTION

The present invention has been developed in order to solve the above drawbacks and other problems associated with conventional arrangements. An aspect of the present invention is to provide micro-fluidic device and pumping method for bio-fluids or chemical liquids through micro channels while eliminating solid frictions and heat loss.

The foregoing objects and advantages are substantially realized by providing a micro fluid pumping device comprising a substrate having a lower pattern of two fluid reservoirs and two channels along which fluid moves between the two fluid reservoirs; a cover having an upper pattern formed for the two fluid reservoirs and the two channels; and a mobile light source externally emitting light at a certain level in order to enable the fluid to move from one fluid reservoir to another fluid reservoir by use of gas bubbles. Where fluid fills the two fluid reservoirs and the two channels, gas bubbles are injected into the two channels respectively through a predetermined sized hole formed in the substrate and/or the cover. The fluid is capable of absorbing light energy.

Here, the substrate and the cover are formed of a transparent substance having a high light penetrability, such as quartz.

Further, light beams from a mobile light source are directed at a front end portion of the gas bubbles in a direction of movement, whereby the mobile light source moves along one of the two channels and emits the light beams.

The foregoing objects and advantages are substantially realized by providing a micro fluid pumping device comprising a first plate; a second plate; a structure adhesion layer adhered between the first plate and the second plate and having a pattern formed for two fluid reservoirs and two channels for moving fluid between the two fluid reservoirs;

and a mobile light source externally emitting light beams at a certain level in order to heat a portion of the fluid to enable the fluid to move from one fluid reservoir to another fluid reservoir by use of gas bubbles injected into the fluid filling the two channels and reservoirs, wherein the bubbles are injected through predetermined sized holes formed in the first plate and/or the second plate and the fluid absorbs light energy.

The first and second plates are formed of a transparent substance having a high light penetrability, such as quartz plates.

Light beams from the mobile light source are directed at a front end portion of the gas bubbles in a direction of movement, whereby the mobile light source moves along one of the two channels and emits the light beams.

The foregoing and other objects and advantages are substantially realized by providing a pumping method for a micro fluid pumping device having plates of predetermined structure for forming two fluid reservoirs and two channels for fluid movement between the two fluid reservoirs, comprising steps of injecting gas bubbles into the fluid filling the two fluid reservoirs and the two channels, through holes formed in the plates, and heating the fluid by the fluid absorbing light energy; and controlling light beams of predetermined level externally directed at the fluid in order to enable the fluid to move from one fluid reservoir to another fluid reservoir by heating a portion of the fluid adjacent to the injected gas bubbles.

Further, the light beam control includes steps of emitting the light beams to generate capillary force with respect to the injected gas bubbles; and directing the movement of the light beams emitted in the light-emitting step along one channel.

Further, the light beam control step directs the light beams into the fluid at a front end portion of the gas bubbles in a direction of movement.

DETAILED DESCRIPTION OF THE PREFERRED EMBODIMENTS

Figure 1:
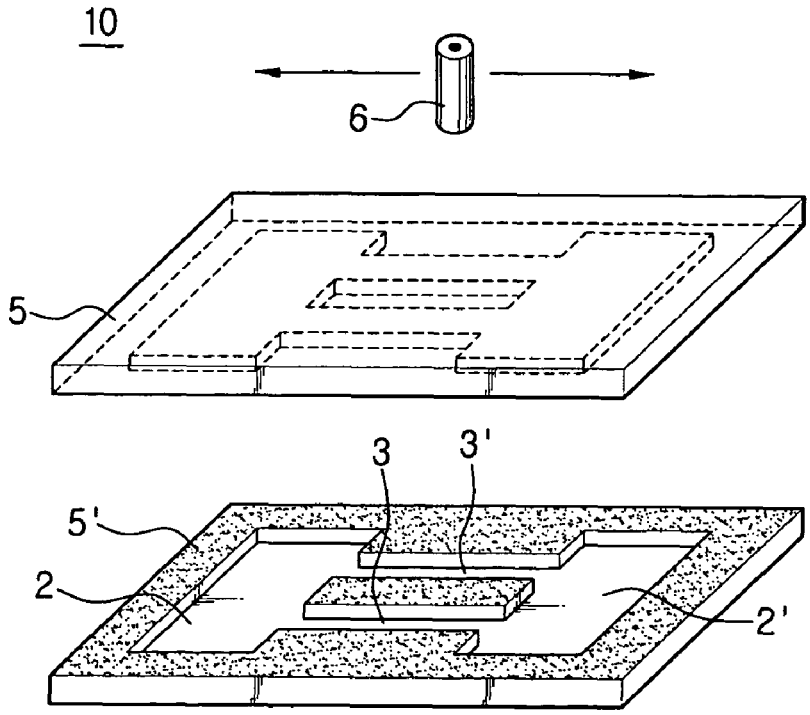
FIG. 1 is a perspective view for schematically showing a micro fluid pumping device according to an embodiment of the present invention.

The micro fluid pumping device and method according to the present invention can pump bio-fluids of liquid chemicals based on active bubbles through micro channels without any mechanical transport parts or resistance heaters since the device and method can precisely carry out the controls on gas bubbles by use of emitted light beams on microscale.

Hereinafter, the present invention will be described in detail with reference to the accompanying drawings. During the description of the present invention, like parts and areas are designated with like reference numerals even in different drawings.

FIG. 1 is a perspective view for schematically showing a micro fluid pumping device according to one embodiment of the present invention. A micro fluid pumping device 10 has cover 5 and substrate 5' on which upper and lower patterns are formed for two fluid reservoirs 2 and 2' and two channels 3 and 3' respectively, and a light source module 6 installed to emit light beams moving along any of the two channels at a certain height over the cover 5.

Figure 2:
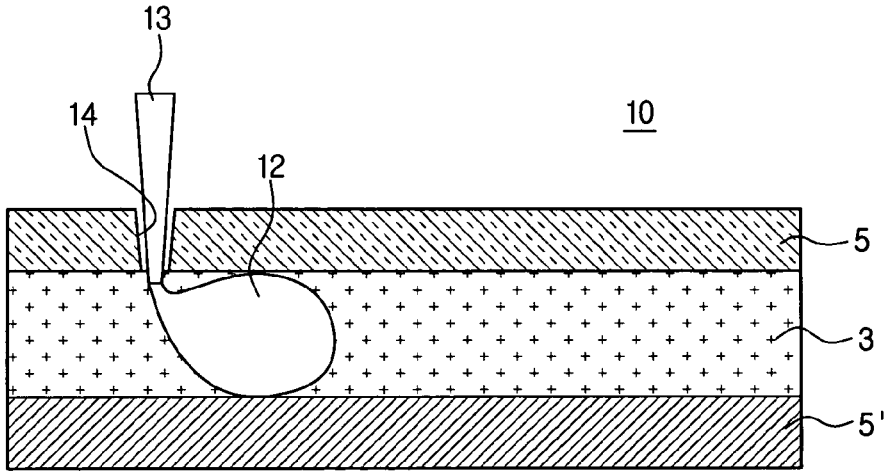
FIG. 2 is a cross-sectioned view for showing a method for the device of FIG. 1 for injecting gas bubbles by use of a syringe.

A very small hole (see FIG. 2) is formed in a portion of the micro fluid pumping device 10 corresponding to the channels 3 and 3' of the cover 5 in order to enable gas bubbles to be injected through an injection unit such as a syringe (see FIG. 2).

The cover 5 and the substrate 5' of the micro fluid pumping device 10 are formed to adhere to each other to form two channels 3 and 3' connecting the two fluid reservoirs 2 and 2'. In order to facilitate the adhesion of the cover 5 and the substrate 5' of the micro fluid pumping device 10, structures in thin-film shape can be utilized for the cover 5 and substrate 5' on which the fluid reservoirs 2 and 2' and the channels 3 and 3' are patterned respectively.

With respect to FIG. 2, in order to enable pumping actions after fluid is filled in the space formed inside the above micro fluid pumping device 10, firstly, gas bubbles 12 formed by ambient air or by a certain inert gas are injected by a syringe 13 through a small hole 14 formed in the cover 5 and at a position corresponding to the micro fluidic channels 3 and 3'. Further, The gas bubbles 12 are driven by capillary force created by thermal control by light beams (not shown) emitted from light source module 6. The light beams are directed at a front end of gas bubbles 12 injected in any of the channels 3 or 3' through the transparent wall of the cover 5. The thermal control of the gas bubbles 12 by the light beams reduces the capillary pressure of the fluid and expels the fluid together with the movements of the gas bubbles as the gas bubbles move through the micro channel 3.

Figure 3A:
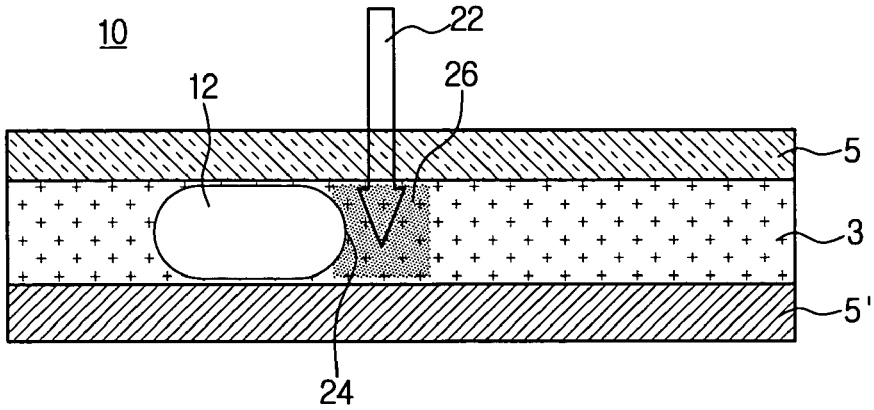
FIGS. 3A to 3D are cross-sectioned views for explaining a fluid pumping process for the device of FIG. 1 using gas bubbles.
Figure 3B:
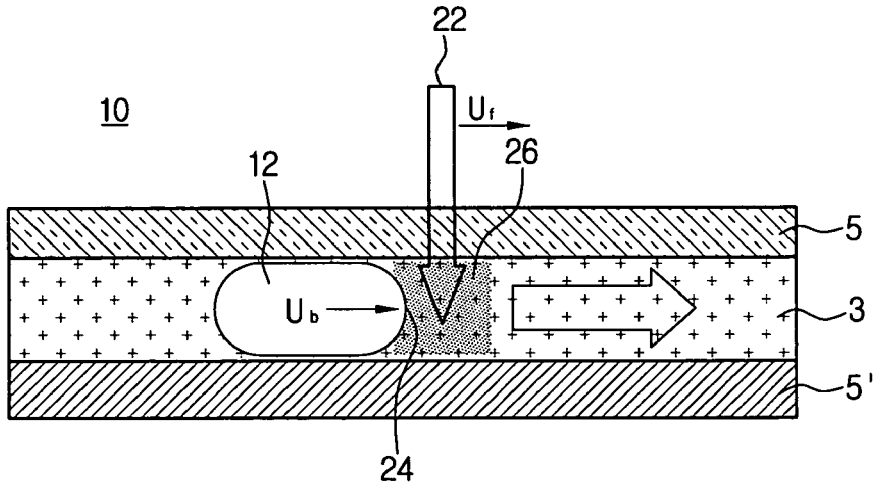
Figure 3C:
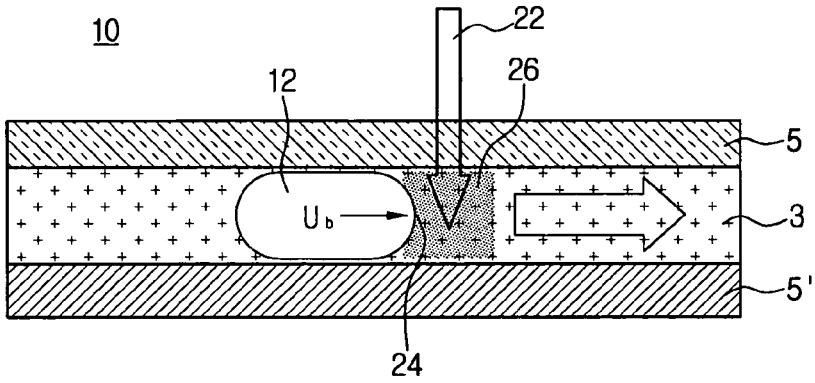
Figure 3D:
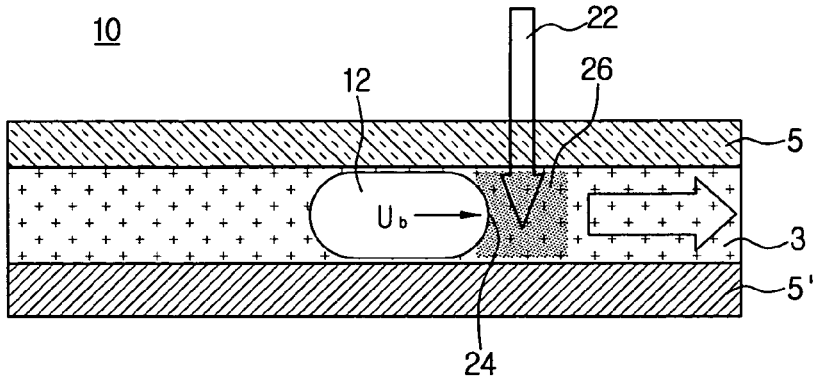

FIGS. 3A to 3D are cross-sectioned views for explaining gas bubble movements due to the capillary force controlled by the light beams in the micro fluid pumping device of FIG. 1. In FIG. 3A, the micro channel 3 is filled with fluid, and has a gas bubble 12 injected therein. The light beams 22 are directed at the fluid at the front end portion 24 of the gas bubble 12 through a portion of the cover 5 over micro channel 3. The light energy is absorbed by fluid at the front end portion 24 and heats the fluid in a local area 26. The heating temperature for the fluid is controlled by the intensity of the light beams, and can be maintained at a level which induces a capillary force. However, the temperature can be maintained lower than a temperature at which the fluid boils. Such heating reduces the surface tension of the heated fluid at local area 26, and generates a capillary pressure difference between the ends of the gas bubble 12. As a result of this capillary pressure difference, the gas bubble 12 moves at a speed of $U_b$ toward the center of the heated fluid at local area 26, as shown in FIGS. 3B to 3D. Such movements of the gas bubble 12 form a pressure gradient ahead of the moving front end portion 24 of the gas bubble 12, and push the fluid out of the micro channel 3. Further, as the light beam 22 moves along the micro channel 3 as shown in FIGS. 3B to 3D, the gas bubble 12 moves toward the center of the newly heated fluid local area 26 as described above.

Therefore, as the light beam moves at a speed of $U_f$ along the micro channel 3, the gas bubble 12 is induced to move at the speed of $U_b$. As a result, this movement creates a pumping action of the fluid, that is, of pushing the fluid out of the micro channel 3.

The fact that capillary force in the microscale field is predominant over other forces in fluid activities is well-known. Controlling such capillary force can serve as a driving mechanism in a fluid-pumping system. A proposed method uses capillary pressure in the micro channel to drive gas bubbles which are propelled by the thermal activities of the light beams.

The volume ratio of thermal source distribution Q in a fluid due to light absorption can be expressed by Bouger-Lambert's law:

$$Q=\epsilon I_0 \exp[-\epsilon(z_0-z)] \quad \text{[Equation]}$$

where $\epsilon$ denotes the light absorption rate of the fluid, $I_0$ is density of focused light beams, $z_0$ is concentration of a fluidic channel, and z is the position in vertical axis.

The local light heating on an end portion of a bubble causes the reduction of surface tension of the pumped fluid and generates a difference in surface tension, $\Delta\delta=|\delta'_T|\Delta T$, between the end portions of the gas bubble and a heat capillary pressure difference, $\Delta P=2\cos\theta\Delta 6/R$. Here, $\delta T$ denotes a temperature surface tension coefficient, $\theta$ a contact angle, R a radius of curvature, and $\Delta T$ a temperature difference between the end portions of the gas bubble.

Light energy can be directly absorbed by fluid and converted to heat very quick. Usually a conversion consumption time is $10^{-10}$ seconds. Therefore, light beams have a prominent advantage in that they are very effective for generating heat.

The use of light beams has another advantage in that the structure of heater and protection layers on the substrate for the micro pumping system is not complicated. Thus, the present invention provides a simplified structure, and special materials are not required to manufacture a pump.

Figure 4:
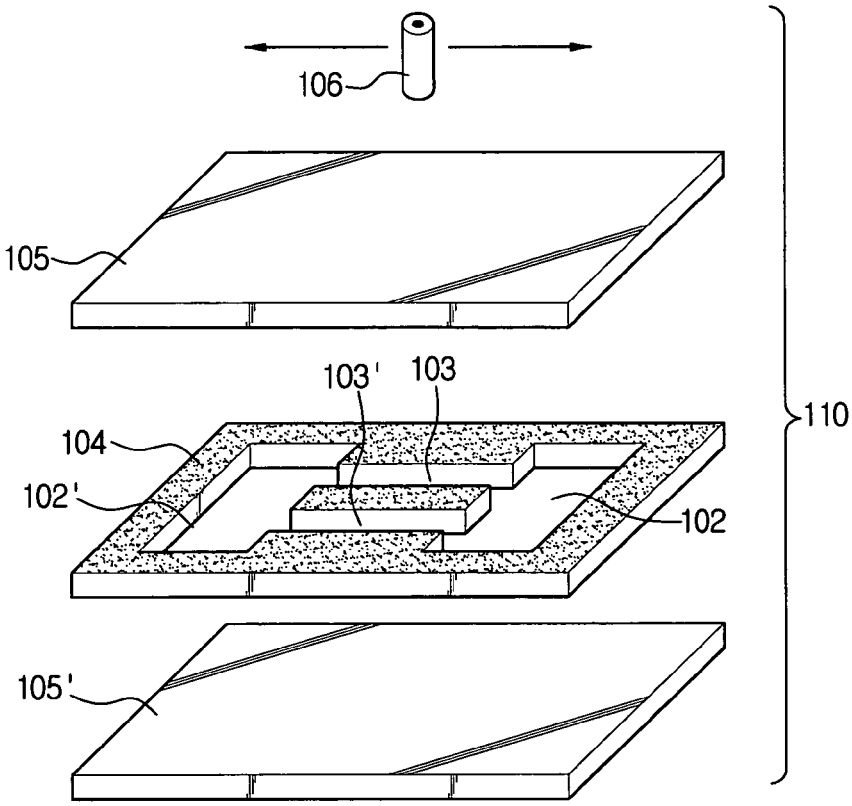
FIG. 4 is a perspective view for schematically showing a micro fluid pumping device according to another embodiment of the present invention.
Figure 5:
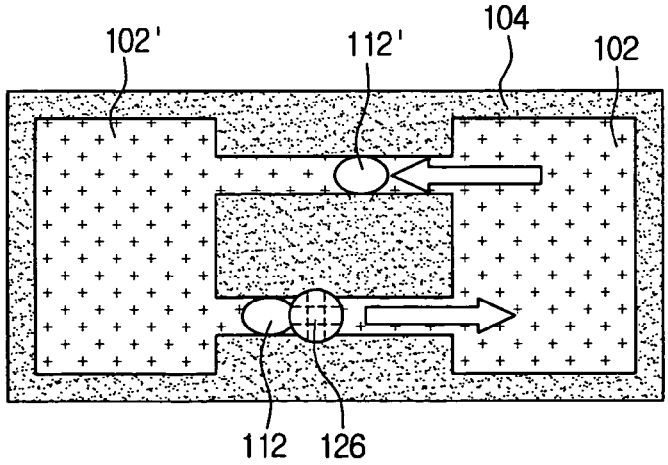
FIG. 5 is a plan view showing a pump filled with two gas bubbles and for moving fluid by using gas bubbles according to an embodiment of the present invention.

FIG. 4 and FIG. 5 are perspective and cross-sectioned views respectively. They schematically show a micro fluid pumping device employing the proposed fluid-pumping method according to another embodiment of the present invention.

A micro fluid pumping device 110 has two quartz plates 105 and 105', a structure layer 104 disposed between the two quartz plates 105, 105' and patterned to have fluid reservoirs 102 and 102' and two channels 103 and 103', and a light source module 106 installed to emit light beams moving along any of the two channels 103 and 103' at a certain height over the upper quartz plate 105.

The micro fluid pumping device 110 has very small holes (not shown) at positions of the quartz plates 105 and 105' corresponding to the channels 3 and 3' so that gas bubbles can be injected through the holes by an injection unit such as a syringe (not shown).

The three layers are formed to adhere to each other, so the micro fluid pumping device 110 has two fluid reservoirs 2 and 2' and two channels 3 and 3' which connect the two fluid reservoirs 2 and 2', and these spaces are filled with fluid.

Both channels 103 and 103' connecting the two fluid reservoirs 102 and 102' are 10 mm length, 1.2 mm wide and 50 μm deep. The structure layer 104 is formed to have two fluid reservoirs 102 and 102' with same depth as the two channels 103 and 103'. A UV lamp is used for the light source 106.

FIG. 5 is a plan view of structure layer 104. Fluid fills the reservoirs and channels. Two gas bubbles 112 and 112' are injected inside. The first gas bubble 112 serves as a piston for pushing the fluid, and the second gas bubble 112' serves as a guide for the flow of fluid. The controlled light beam 126 is emitted at an intensity of 50 mW/mm$^2$ from the UV lamp, and also is directed at the fluid near a front portion of the piston bubble 112 through the upper quartz plate 105. The piston bubble 112 moves from left to right at a maximum velocity of $U_b$=0.3 mm/s together with the light beam due to a capillary force, and, at the same time, the guide bubble 112' is pushed in opposite direction due to a pressure head formed by the moving piston bubble.

The above micro fluid pumping device showed a transport rate of more than 1 μl per minute in actual experiments.

According to this embodiment of the present invention, the quartz plates are used in the micro fluid pumping device. However, other transparent substances can be used in place of the quartz plates, and diverse light beam sources can be used for the light source 106, ranging from UV lamps to laser beams or even to VCSEL arrays.

The micro fluid pumping device and method according to the present invention can be applied to diverse micro-fluidic systems since the device and method can move bio-fluid or chemical solutions more precisely by moving gas bubbles by light in microscale.

Further, using light and bubbles enables the micro fluid pumping device and method to perform fluid pumping actions even in low temperatures.

The foregoing embodiments are just typical examples of the present invention and they should not be construed to limit the present invention in any way. The present invention can be readily applied to other types of devices and methods. Also, the description of the embodiments of present invention is intended to be illustrative only, and not to limit the scope of the claims. Many alternatives, modifications, and variations will be apparent to those skilled in the art.

What is claimed is:

1. A micro fluid pumping device, comprising:

a substrate having a pattern which forms two fluid reservoirs and two channels wherein each channel connects one fluid reservoir to the other fluid reservoir;

a cover positioned on a top surface of said substrate;

a fluid which fills said two fluid reservoirs and said two channels; and a movable light source which generates light and emits the generated light at a predetermined level for moving the fluid from one fluid reservoir to the other fluid reservoir by heating a portion of said fluid adjacent to a gas bubble injected into said fluid in one of the respective two channels through a predetermined sized hole in the substrate and/or the cover, wherein the movable light source moves in parallel with the one of the respective two channels and emits the generated light into the fluid such that the emitted light enters the fluid in a direction that is substantially perpendicular to the fluid by a constant light intensity at all times, thereby the gas bubble moves at a constant speed corresponding to a moving speed of the light beam, wherein a heating temperature for the fluid is controlled by a light intensity of the movable light source and is maintained at a level which induces a capillary pressure difference between ends of the gas bubble.

2. The micro fluid pumping device as claimed in claim 1, wherein the cover is formed from a transparent substance.

3. The micro fluid pumping device as claimed in claim 1, wherein the cover is formed from a substance having a high degree of transparency.

4. The micro fluid pumping device as claimed in claim 1, wherein the movable light source directs emitted light along one of two channels.

5. The micro fluid pumping device as claimed in claim 4, wherein a light beam from the movable light source is directed at a front end portion of said gas bubble in a direction of movement along said one of the two channels.

6. A micro fluid pumping device, comprising:

a first plate;

a second plate;

a structure layer positioned between the first plate and the second plate and having a pattern which forms two fluid reservoirs and two channels wherein each channel connects one fluid reservoir to the other fluid reservoir;

a fluid which fills said two fluid reservoirs and said two channels; and a movable light source which generates a light beam and emits the generated light beam at a predetermined level for moving the fluid from one fluid reservoir to the other fluid reservoir by heating a portion of said fluid adjacent to a gas bubble injected into said fluid in one of the respective two channels through a predetermined sized hole formed in the first plate and/or the second plate, wherein the movable light source moves in parallel with the one of the respective two channels and emits the generated light into the fluid such that the emitted light enters the fluid in a direction that is substantially perpendicular to the fluid by a constant light intensity at all times, thereby the gas bubble moves at a constant speed corresponding to a moving speed of the light beam, wherein a heating temperature for the fluid is controlled by a light intensity of the movable light source and is maintained at a level which induces a capillary pressure difference between ends of the gas bubble.

7. The micro fluid pumping device as claimed in claim 6, wherein the first and second plates are formed from a transparent substance.

8. The micro fluid pumping device as claimed in claim 6, wherein the first and second plates are formed from a substance having a high degree of transparency.

9. The micro fluid pumping device as claimed in claim 6, wherein the movable light source directs emitted light along one of the two channels.

10. The micro fluid pumping device as claimed in claim 9, wherein a light beam from the movable light source is directed at a front end portion of said gas bubble in a direction of movement along said one of the two channels.

11. A pumping method for a micro fluid pumping device having two fluid reservoirs and two channels for moving fluid between the two fluid reservoirs, comprising:

injecting a gas bubble into one of the two respective channels;

generating, by a movable light source, a light beam; and emitting, from the movable light source, the generated light beam at a portion of said fluid adjacent to one or more of said gas bubbles to heat said portion of said fluid in order to move the fluid from one fluid reservoir to the other fluid reservoir by movement of the injected gas bubble, wherein the movable light source moves in parallel with the one of the respective two channels and emits the generated light into the fluid such that the emitted light enters the fluid in a direction that is substantially perpendicular to the fluid by a constant light intensity at all times, thereby the gas bubble moves at a constant speed corresponding to a moving speed of the light beam, wherein a heating temperature for the fluid is controlled by a light intensity of the movable light source and is maintained at a level which induces a capillary pressure difference between ends of the gas bubble.

12. The pumping method as claimed in claim 11, wherein directing the light beam includes the steps of:

emitting the light beam to generate a capillary force with respect to the gas bubble injected into the channel; and moving the light beam directed into the fluid along the one of the channels.

13. The pumping method as claimed in claim 12, wherein the light beam is directed at a front end portion of the gas bubble in a direction of movement along said channel.

* * * * *